United States Patent [19]

Tsubata et al.

[11] 4,383,558

[45] May 17, 1983

[54] WOVEN SLIDE FASTENER STRINGER

[75] Inventors: Noritaka Tsubata, Uozu; Muchiji Shimono, Namerikawa, both of Japan

[73] Assignee: Yoshida Tokyo K. K., Tokyo, Japan

[21] Appl. No.: 235,917

[22] Filed: Feb. 19, 1981

[30] Foreign Application Priority Data

Feb. 20, 1980 [JP] Japan ..... 55-20015

[51] Int. Cl.[3] ..... D03D 1/00; A44B 19/34

[52] U.S. Cl. ..... 139/384 B; 24/205.16 C

[58] Field of Search ..... 139/384 B, 384 R, 116; 24/205.1 C, 205.13 C, 205.16 C

[56] References Cited

U.S. PATENT DOCUMENTS 4,188,982 2/1980 Yoshida et al. ..... 139/384 B 4,210,180 7/1980 Tsubata ..... 139/384 B 4,215,729 8/1980 Ofusa ..... 139/384 B 4,220,182 9/1980 Glindmeyer et al. ..... 139/384 B

*Primary Examiner*—James Kee Chi

[57] ABSTRACT

A woven slide fastener stringer comprises a binding thread system extending along a row of continuous coupling elements and fixing the latter to a longitudinal tape edge portion of a woven stringer tape. The binding thread system includes a warp thread extending through a space defined in the coupling element row and underlying the upper legs adjacent to the coupling heads of the coupling elements, and a weft thread having first loops interlaced with the longitudinal tape edge portion and second loops each overlying the upper leg of one of the coupling elements in transverse relation adjacent to the coupling head and underlying the warp thread at positions one on each side of the upper leg, whereby the upper legs are sandwiched between the warp and weft threads.

6 Claims, 2 Drawing Figures

WOVEN SLIDE FASTENER STRINGER

BACKGROUND OF THE INVENTION

1. Field of the Invention

The present invention relates to a slide fastener, and more particularly to a slide fastener stringer having a row of successive interconnected or continuous coupling element loops woven into and along a longitudinal edge of a woven stringer tape.

2. Prior Art

Various woven fastener stringers are known which include binding means fixing a row of continuous coupling elements or loops firmly to a longitudinal tape edge with increased strength. U.S. Pat. No. 4,210,180 issued July 1, 1980 discloses one such prior art stringer wherein a row of coupling elements in the form of loops woven into a longitudinal edge of a woven stringer tape is secured firmly to the tape by the combination of a number of binding warp threads overlying the upper legs of the loops and a binding weft thread interlaced with the warp threads and interwoven with the foundation weft thread of the tape. To increase positional stability of the loops, some of the binding warp threads extend along an undulation path and are interlaced with the foundation weft thread in the spaces between adjacent element loops. Together with a plurality of reinforcing cords extending longitudinally through the loops, the undulated warp thread portions and a number of interlacings of the warp threads with the weft threads occupy the inter-loop spaces, thereby making the fastener stringer too rigid and complex or dense in structure. Although the prior art fastener stringer is useful when dimensioned for a relatively large-sized slide fastener, it has proven disadvantageous when manufactured as a small-sized slide fastener stringer in that the threads are compacted in relatively samll inter-loop spaces. Such a small-sized slide fastener stringer, hence, has an element-supporting edge portion rendered undesirably rigid and reduced spaces defined between adjacent loops for interdigitating engagement with loops of the mating stringer, with the result that the interengaged element loops of the slide fastener are liable to be broken or split open when subjected to undue bending stresses.

SUMMARY OF THE INVENTION

A woven slide fastener stringer comprises a woven stringer tape having a longitudinal edge portion, a row of continuous coupling elements disposed on the longitudinal edge portion and defining a space therethrough and a binding thread system extending along the row of continuous coupling elements and fixing the latter to the longitudinal tape edge portion. The binding thread system includes a warp thread extending through the space and underlying the upper legs adjacent to the coupling heads of the coupling elements, and a weft thread having first loops interlaced with the longitudinal tape edge portion and second loops each overlying the upper leg of one of the coupling elements in transverse relation adjacent to the coupling head and underlying the warp thread at positions one on each side of the upper leg, whereby the upper legs are sandwiched by the warp and weft threads. The binding thread system further includes a pair of warp threads overlying the upper legs and having undulated portions interlaced with the longitudinal tape edge portion at alternate inter-loop positions.

It is therefore an object of the present invention to provide a woven slide fastener stringer which has a row of continuous coupling elements or loops firmly secured to a woven tape edge by a binding thread system having a relatively simple or coarse structure.

Another object of the invention is to provide a woven fastener stringer having a desired flexibility and a relatively wide region or space for interdigitating engagement of the loops with those of a mating stringer even when dimensioned for a small size slide fastener.

Many other advantages, features and additional objects of the present invention will become manifest to those versed in the art upon making reference to the detailed description and accompanying drawings in which a preferred structural embodiment incorporating the principles of the present invention is shown by way of example.

DETAILED DESCRIPTION

Figure 1:
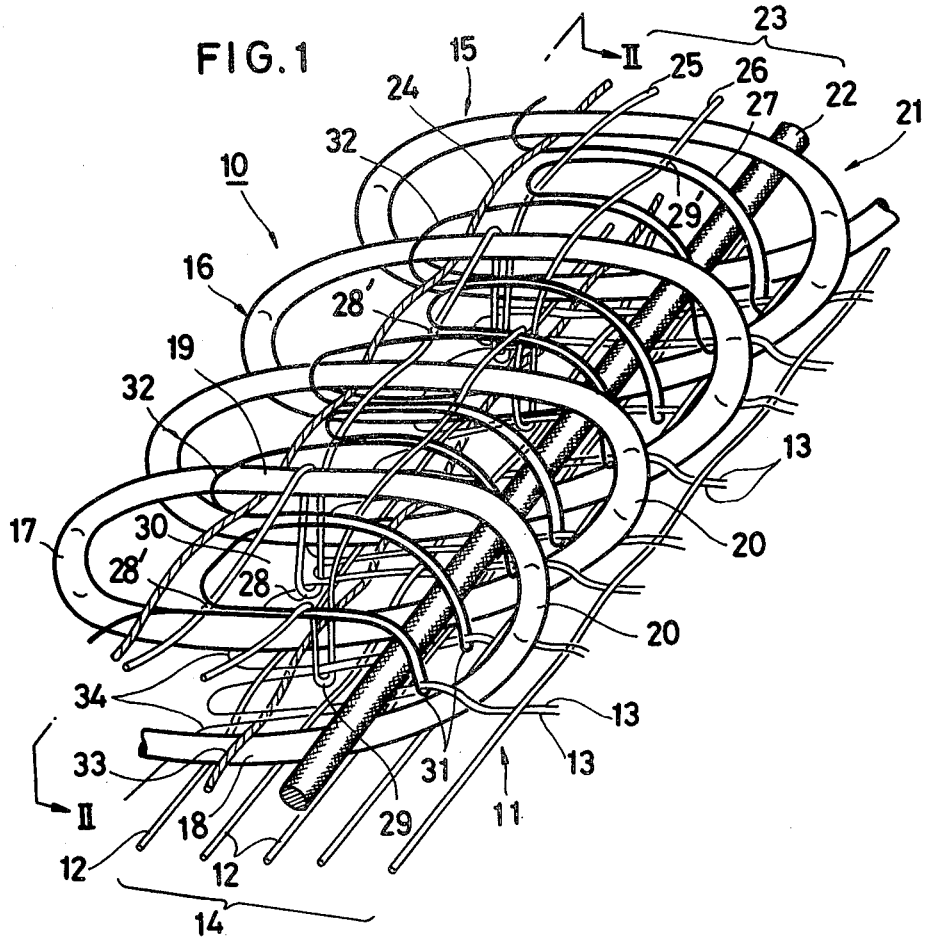
FIG. 1 is an enlarged fragmentary perspective view of a woven fastener stringer according to the present invention.
Figure 2:
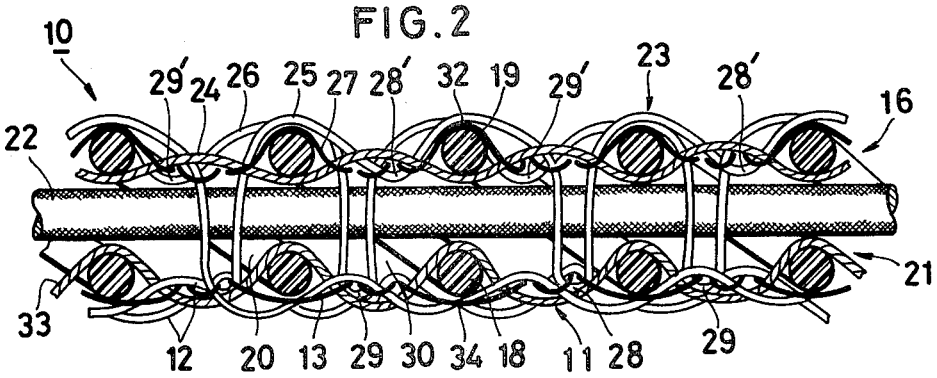
FIG. 2 is a cross-sectional view taken along line II—II of FIG. 1.

The principles of the present invention are particularly useful when embodied in a woven slide fastener stringer such as shown in FIGS. 1 and 2, generally indicated by the numeral 10.

The stringer 10 which constitutes one part of a pair or two identical stringers for a slide fastener includes a stringer tape 11 woven with foundation warp threads 12 and a foundation weft thread 13 and having a longitudinal edge portion 14 into and along which a filament 15 of plastic material is woven. The filament 15 is formed from a linear blank of a suitable plastic material into a helically coiled structure having a row of successive interconnected or continuous coupling element loops 16. This is done during the course of weaving of the tape 11 in a well known manner.

Each of the coupling element loops 16 in the filament 15 has a coupling head 17, a pair of spaced legs 18 and 19 extending from the head 17, and heel portions 20 extending respectively from the legs 18,19 remotely from the head 17 and connected to adjacent two of the successive coupling element loops 16. One or a lower one of the legs 18 is disposed on the longitudinal edge portion 14 and is arranged in substantially underlying relation to the other or upper leg 19 as shown in FIG. 2. The coupling head 17, the legs 18,19 and the heel portions 20 jointly define therebetween a space or tunnel 21 through which a reinforcing cord or stuffer warp 22 extends longitudinally. The coupling head 17 is dimensioned to releasably couple with a corresponding head of a loop on a mating stringer (not shown) to open and close the fastener in a well known manner.

In addition to the foundation warp threads 12 and foundation weft thread 13 in the longitudinal tape edge portion 14, there is provided a binding thread system 23 extending along the row of coupling element loops 16 and fixing the latter to the longitudinal edge portion 14. The binding thread system 23 comprises at least three binding warp threads 24,25,26 and a continuous binding weft thread 27 co-operating with the binding warp threads 24,25,26 in binding or anchoring the row of coupling element loops 16 firmly in place on the stringer tape 11. The binding warp threads 24,25,26 extend longitudinally of the tape 11 in interlaced relation to the binding weft thread 27. The outermost one of the binding warp thread 24 extends through the space 21 and underlies the upper legs 19 adjacent the coupling heads 17. The other binding warp threads, two (25,26) being shown, overlie the upper legs 19 of the loops 16 and extend along an undulation path over the upper legs 19 of the loops 16.

Each of the successive coupling element loops 16 of the filament 15 has its lower leg 18 disposed on and secured to the longitudinal tape edge portion 14 by the foundation warp and weft threads 12,13. In order to stabilize the positioning of the lower legs 18 to the tape 11, the binding warp threads 25,26 have their respective undulated portions 28,29 interlaced with the foundation weft thread 13 at alternate inter-loop positions in inter-loop spaces 30 defined between each pair of loops 16 and in a plane defined commonly by the lower surface of the lower legs 18. In the illustrated embodiment wherein two other binding warp threads 25,26 are used, the undulated portions 28,29 of the warp threads 25,26 which are interlaced with the foundation weft thread 13 are disposed in the inter-loop spaces 30 between every other pair of loops 16 of the filament 15, in which instance each undulated portion 28 of one binding warp thread 25 is shifted one loop pitch away with respect to one of the undulated portions 29 of the other or adjacent binding warp thread 26. In other words, each of the two binding warp threads 25 and 26 extends over the upper surfaces of the upper legs 19 of two successive coupling element loops 16 and comes into interlaced engagement with the foundation weft thread 13 in a next adjoining inter-loop space 30 and the undulated portions 28,29 of the respective binding warp threads 25,26 interlacing with the foundation weft thread 13 are not in the same inter-loop space 30 but alternate with respect to each other. It will be noted that if three of the other binding warp threads are employed, they are interlaced with the foundation weft thread 13 in the inter-loop spaces 30 between every three pair of loops 16 of the filament 15 and the undulated portions thereof are shifted one loop pitch away with respect to one another. Thus, only one interlaced undulated portion of the binding warp threads with the foundation weft thread 13 is formed in each inter-loop space 30 of the filament 15.

The binding weft thread 27 is inserted in double picks substantially in a common plane defined by the uppermost surfaces of the upper legs 19 of the successive coupling element loops 16 and extends warpwise substantially the entire length of the leg portions 18 (19) intermediate the coupling heads 17 and the heel portions 20 in the inter-loop spaces 30 between each adjacent pair of loops 16.

The binding weft thread 27 passes around the binding warp thread 25 and loops around the foundation weft thread 13 at a position 31 in the space 21 adjacent to the heel portions 20 which interconnect the upper leg 19 of one loop with the lower leg 18 of a next adjacent loop of the filament 15. On its return trip, the binding weft thread 27 passes over the stuffer warp 22 and then alternately over and under the binding warp threads 25,26. According to an important feature of the invention, the binding weft thread 27 has loops 32 each underlying the outermost binding warp thread 24 in one inter-loop space 30, extending over and across one of the upper leg 19 adjacent to the coupling head 17, and underlying the outermost warp thread 24 in a next adjacent inter-loop space 30, whereby the upper legs 19 are sandwiched between the outermost binding warp thread 24 and the binding weft thread 27.

Because of the undulating path of the binding warp threads 25,26 described hereinbefore, in every inter-loop space 30 between each adjacent pair of successive loops 16, one binding warp thread 25 (26) is interlaced with the foundation weft thread 13 at the undulated portions 28 (29) while the other binding warp thread 26 (25) is interlaced with the binding weft thread 27 at a junction 28' (29'), as clearly shown in FIG. 2. The binding weft thread 27 cooperates with the binding warp threads 24,25,26 in binding the upper legs 19 in particular against displacement and thus preventing the loops 16 of the filament 15 as a whole from moving out of alignment when the fastener is subjected to bending stresses.

In the preferred embodiment, there is provided an additional binding warp thread 33 which extends longitudinally through the space or tunnel 21 in the succession of loops 16 and overlies the lower legs 18 in substantially aligned relation to the outermost warp thread 24. The foundation weft thread 13 has loops 34 each overlying the additional binding warp thread 33 in one inter-loop space 30, extending under and across one of the lower legs 18 adjacent to the coupling head 17, and overlying the additional binding warp thread 33 in a next adjacent inter-loop space 30, whereby the lower legs 18 are sandwiched between the additional binding warp thread 33 and the foundation weft thread 13. With this arrangement, the positional stability of the lower leg 18 with respect to the tape 11 is further increased. The outermost foundation warp thread 12 which is disposed outside the binding warp thread 33 remotely from the heel portions 20 may be omitted.

Preferably, during the weaving of the stringer 10, the outermost binding warp thread 24 and the additional warp thread 33 are tensioned to a greater degree than other warp threads 13,25,26 of the tape and the binding thread system 11 and 23, with the result that junctions interlacing the binding warp threads 24 and 33 with the weft threads 27 and 13, respectively are arranged in substantially aligned relation to one another, providing firm binding of the upper and lower legs 19,18 between the binding warp threads 24,33 and the weft threads 27,13, respectively.

Furthermore, the binding warp threads 24,33 are made preferably of a multifilament yarn having a greater coefficient of thermal contraction or shrinkage than that of the other warp threads 12,25,26. When such binding warp threads 24,33 are subjected to a thermal treatment by applying a heated medium, for instance, during a dying process, because of their coefficient of thermal contraction they are shrunk to make the interlaced engagement of the warp threads 24,33 with the weft thread 27,13 tighter, causing the filament 15 to be supported on the tape edge portion 14 with a substantially increased degree of tightness.

As will be understood from the foregoing description and the drawings, there exists only one stuffer warp 22 disposed in the space or tunnel 21 in the filament loops 16 adjacent to the heel portions 20 thereof, and in each inter-loop space 30, one junction of interlacing of the binding warp thread 25 (26) with the foundation weft thread 13 as well as junctions of interlacing of the binding warp threads 24, 33 respectively with the weft threads 27,13. Thus, due to a relatively coarse interlaced structure and a reduced number of threads disposed in the inter-loop space 30, the fastener stringer 10 has enough flexibility and a relatively large interengaging region in the inter-loop space 30 adjacent to the coupling head 17, that are desired to be used particularly for small slide fastener.

Although various minor modifications may be suggested by those versed in the art, it should be understood that we wish to embody within the scope of the patent warranted thereon, all such embodiments as reasonably and properly come within the scope of our contribution to the art.

What is claimed is:

1. A woven slide fastener stringer comprising:

(a) a woven stringer tape woven with foundation warp threads and a foundation weft thread and having a longitudinal edge portion;

(b) a row of continuous coupling elements disposed on said longitudinal edge portion and defining a space therethrough, each of said coupling elements including a coupling head, a pair of spaced legs extending from said coupling head, one of said legs being mounted on said tape edge portion, and heel portions extending respectively from said legs remotely from said coupling head; and (c) a binding thread system extending along said row of continuous coupling elements and fixing the latter to said longitudinal tape edge portion, said binding thread system including (1) a binding warp thread extending through said space and underlying the other legs adjacent to said coupling heads, (2) a binding weft thread having first loops looping around said foundation weft thread in said space adjacent to said heel portions, and second loops each overlying the other leg of one of said coupling elements in transverse relation adjacent to said coupling head and underlying said binding warp thread at positions one on each side of said other legs, whereby said other legs are sandwiched between said binding warp thread and said second loops of said binding weft thread.

2. A woven slide fastener stringer according to claim 1, said binding thread system further including a pair of binding warp threads overlying said other legs and having undulated portions interlaced with said foundation weft thread of said longitudinal tape edge portion at alternate inter-loop positions.

3. A woven slide fastener stringer comprising:

(a) a stringer tape woven with foundation warp threads and a foundation weft thread and having a longitudinal edge portion;

(b) a row of successive interconnected coupling element loops woven into and along said longitudinal edge portion, each of said coupling element loops having a coupling head, a pair of spaced legs extending from said head, one of said legs being disposed on said longitudinal edge portion, and heel portions extending respectively from said legs remotely from said head and connected to adjacent two of said successive coupling element loops, said coupling head, legs and heel portions jointly defining a space therebetween;

(c) a stuffer warp extending longitudinally through said space; and (d) a binding thread system comprising: at least three binding warp threads extending longitudinally along said row of coupling element loops, the outermost one of said binding warp threads extending through said space and underlying the other legs adjacent to said coupling heads, the other binding warp threads overlying said other legs and having undulated portions interlaced with said foundation weft thread at alternate inter-loop positions; and a binding weft thread interlaced with said binding warp threads and looping around said foundation weft thread in said space adjacent to said heel portions, said binding weft thread having loops each underlying said one binding warp thread, extending over and across one of said other legs adjacent to said coupling head, and underlying said one binding warp thread, whereby said other legs are sandwiched between said outermost binding warp thread and said loops of said binding weft thread.

4. A woven slide fastener stringer according to claim 3, further including an additional binding warp thread extending longitudinally through said space and overlying said one legs in substantially aligned relation to said one binding warp thread, said foundation weft thread having loops each overlying said additional binding warp thread, extending under and across one of said one legs and overlying said additional binding warp thread, whereby said one legs are sandwiched between said additional binding warp thread and said loops of said foundation weft thread.

5. A woven slide fastener stringer according to claim 3 or 4, said one and additional binding warp threads comprising multifilament yarns having a coefficient of thermal contraction greater than that of the other warp threads.

6. A woven slide fastener stringer according to claim 3 or 4, said one and additional binding warp threads being tensioned to a greater degree than the other warp threads.

* * * * *